US005634215A

United States Patent [19]

DeBaene

[11] Patent Number: 5,634,215

[45] **Date of Patent: *Jun. 3, 1997**

[54] WORK PANT GARMENT FABRICATED FROM ABRASION-RESISTANT MATERIAL COATED WITH POLYURETHANE

[75] Inventor: David N. DeBaene, West Warwick, R.I.

[73] Assignee: JD American Workwear, Inc., Coventry, R.I

[ * ] Notice: The term of this patent shall not extend beyond the expiration date of Pat. No. 5,038,408..

[21] Appl. No.: 540,587

[22] Filed: Oct. 6, 1995

[51] Int. Cl.[6] ..... A41D 1/06

[52] U.S. Cl. ..... 2/227; 2/79; 2/69

[58] Field of Search ..... 2/227, 228, 79, 2/69, 80, 51, 214, 267

[56] References Cited

U.S. PATENT DOCUMENTS 4,922,551 5/1990 Anthes ..... 2/79

5,038,408 8/1991 DeBaene .

*Primary Examiner*—C. D. Crowder

*Assistant Examiner*—Gloria Hale

*Attorney, Agent, or Firm*—Salter & Michaelson

[57] ABSTRACT

A work pant garment for use by a wearer in an environment wherein the garment is subject to excessive wear conditions includes an upper portion that has a front panel and a seat panel, and a lower portion that has pant legs which are integrally joined to the front seat and panels and that extend downwardly therefrom. Both of the upper and lower portions are formed of a woven material that is fabricated from heavy duty yarns. Moreover, the seat panel and pant legs each have an overlay panel affixed thereto, each of which are formed of an abrasion-resistant material that is defined by woven yarns that are selected from a group consisting of nylon and polypropylene. A polyurethane coating is adhered to the inner surfaces of the overlay panels for preventing migration of moisture through the panels.

7 Claims, 2 Drawing Sheets

WORK PANT GARMENT FABRICATED FROM ABRASION-RESISTANT MATERIAL COATED WITH POLYURETHANE

BACKGROUND AND SUMMARY OF THE INVENTION

This invention relates generally to clothing, and more particularly to a work pant garment which is designed to be worn by construction workers.

There are certain situations in the construction and industrial trades in which a worker is subjected to handling or working with abrasive materials that cause undo and accelerated wear of the worker's clothing. An example of such a job is roofing because the surface which is being worked on (shingles and roofing boards) is particularly rough in texture. Thus, a worker kneeling or sitting on these types of surfaces experiences increased wear on the worker's pants. Typically, a worker performing these jobs wears denim pants or jeans. However, these garments are inadequate since the abrasion on the pants causes the pants to wear rather rapidly. One known solution to increased wear in the knee and seat portions of pants has been to wear rubber pads secured to the worker's legs by elastic bands. However, these pads tend to twist, fall down, and/or cut off the blood circulation to the wearer's legs.

Reference can be made to my U.S. Pat. No. 5,038,408 which is the best known prior art in this area. This patent discloses work pants having a waist portion with a front panel and a rear panel, and two leg portions. Each leg portion includes a reinforcing panel in the knee area. The rear panel of the waist portion is formed of a highly wear-resistant sheet material fabricated from leather with the rough surface facing outwardly. The reinforcing panel in the knee area consists of a lamination of an inner resilient pad and an outer wear-resistant sheet fabricated from leather with the rough unfinished surface facing outwardly.

This construction, while being especially effective in providing wear-resistance to the pants, suffers from several drawbacks. For example, leather material is somewhat expensive thereby increasing the overall cost of the jeans. Moreover, the leather is not as washable as other materials. There is presently a need for a wear-resistant material similar to leather which can be used to reinforce wear areas of pants that is not as expensive as leather and can be washed.

The present invention is directed to a work pant garment for use by a wearer in an environment wherein the garment is subject to excessive wear conditions. The garment comprises an upper portion that includes a seat and a lower portion that includes pant legs that are integrally joined to the seat and that extend downwardly therefrom. Both of the upper and lower portions are formed of a woven material that is comprised of heavy duty yarns. Moreover, the seat and pant legs each have an overlay panel affixed thereto, each of which are formed of an abrasion-resistant material that is defined by woven yarns that are selected from a group consisting of nylon and polypropylene. A polyurethane coating is adhered to the inner surfaces of the overlay panels for preventing migration of moisture through the panels.

More specifically, the overlay panels are formed of a blended weave of nylon and polypropylene materials, and each of the pant legs has a knee portion on which the overlay panel is applied. The knee portion overlay panel further includes a closed cellular foam pad that is adhered to the abrasion-resistant woven material. A two-part contact adhesive is applied to the foam pad for adhering the overlay panel to the abrasion-resistant woven material.

Accordingly, among the several objects of the present invention are the provision of a wear-resistant work pant garment having reinforcement panels in wear areas of the garment which are more wear-resistant than leather; the provision of such a garment having said panels which are capable of being washed regularly without loosing its durability; the provision of such a garment which is especially suited for roofing work and the like thereby protecting the worker from abrasion caused by contact with the roof and any associated discomfort; the provision of such a garment which is simple and rugged in design; the provision of such a garment which is inexpensively manufactured from readily available materials; the provision of such a garment having protective knee pads which cushion any impacts and abrasive contact with the wearer's knees; and the provision of such a garment which is aesthetically pleasing in appearance.

Other objects, features and advantages of the invention shall become apparent as the description thereof proceeds when considered in connection with the accompanying illustrative drawings.

BRIEF DESCRIPTION OF THE DRAWINGS

In the drawings which illustrate the best mode presently contemplated for carrying out the present invention.

Corresponding reference numerals designate corresponding parts throughout the several views of the drawings.

DETAILED DESCRIPTION OF THE PREFERRED EMBODIMENT

Figure 1:
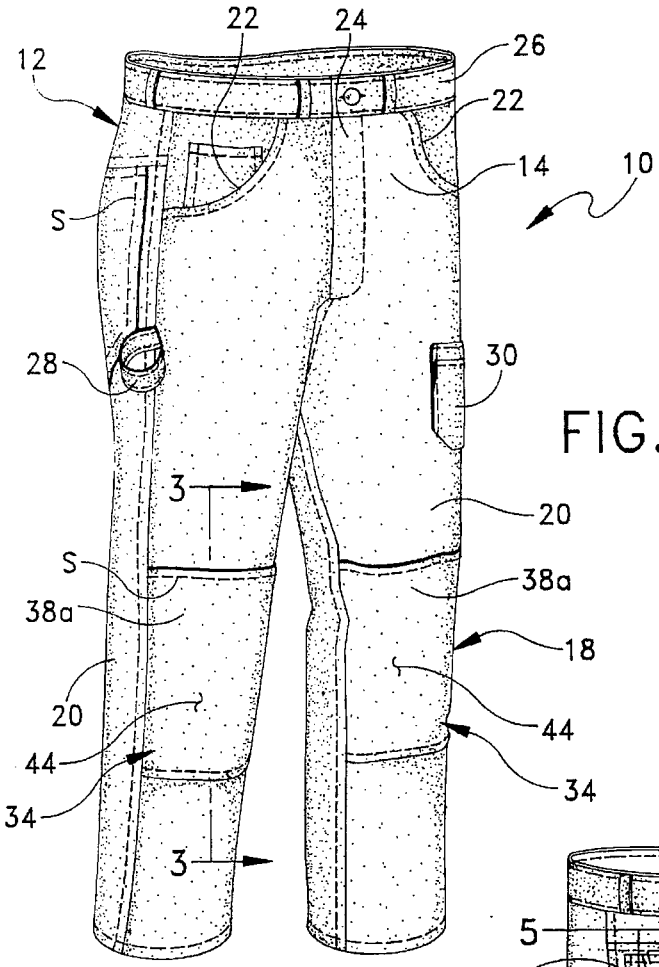
FIG. 1 is a front perspective view of a work pant garment of the present invention.
Figure 2:
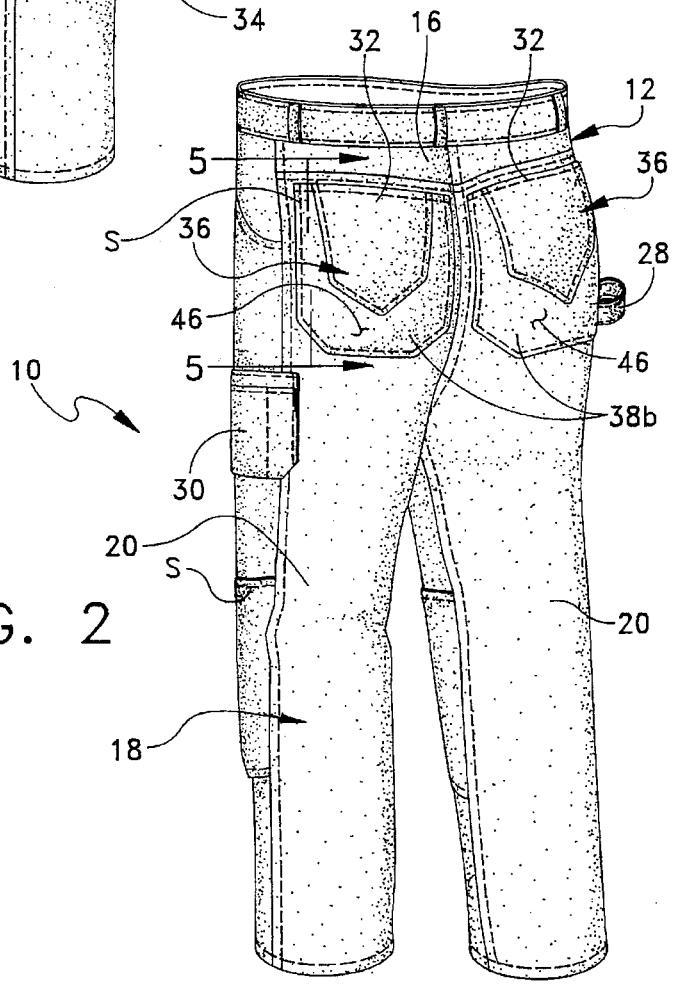
FIG. 2 is a rear perspective view thereof.

Referring now to the drawings, and more particularly to FIGS. 1 and 2, there is generally indicated at 10 a work pant garment of the present invention which is especially designed for construction work. The garment 10 is suited for use by a wearer in an environment where the garment 10 is subject to excessive wear conditions, such as frequent engagement with rough shingles and roofing boards, during landscaping, or for industrial use, for example.

As illustrated in FIGS. 1 and 2, the arrangement of the garment 10 is of conventional design, the garment 10 having an upper portion generally indicated at 12 that includes a front panel 14 (FIG. 1) and a rear or seat panel 16 (FIG. 2), and a lower portion generally indicated at 18 that includes pant legs, each indicated at 20. The pant legs 20 are integrally joined to the front and seat panels 14, 16 in the typical manner and extend downwardly therefrom. The front panel 14 of the upper portion 12 of the garment 10 has a pair of pockets each indicated at 22 which are sewn therein and a fastening arrangement 24 including a zipper and a top button for securing the garment 10 to the wearer after it has been put on. The upper portion 12 also includes a waistband 26. Along opposite seams of the pant legs 20 are a hammer or a utility loop 28 which is sewn to the right-hand leg (seen FIG. 1) 20 at its outer side and a pocket 30 which is sewn to the left-hand leg 20 at its outer side, the pocket 30 being suitably sized for holding pencils and other larger objects, such as utility knifes. The seat panel 16 of the upper portion 12 includes a pair of pockets 32, the construction of which will be discussed in greater detail below.

The upper and lower portions 12, 18 of the garment 10 are formed of a woven material that is comprised of heavy duty yarns. More particularly, the portions 12, 18 are preferably fabricated from 8½ ounce blended twill fabric material which is taken from a blend of 65 percent polyester and 35 percent cotton. This fabric is of high quality and is particularly durable and rugged. However, it should be understood that the upper and lower portions 12, 18 may be fabricated from any of a number of suitable fabric materials which are durable and comfortable to wear.

The pant legs 20 and the seat panel 16 of the garment 10 each have a pair of overlay panels, generally indicated at 34, 36, respectively, affixed thereto by suitable stitching S. As shown, the overlay panels 34 of the pant legs are located at the knee portions thereof. As illustrated in FIG. 2, there are two separate seat overlay panels 36; however, a single overlay panel covering the entire seat panel 16 may be provided and still fall within the scope and spirit of the present invention. Each overlay panel 34, 36 is preferably fabricated from an abrasion-resistant material that is defined by woven yarns that are selected from a group consisting of nylon and polypropylene. More particularly, the panels 34, 36 are formed of a blended weave of nylon and polypropylene materials which have an unusually high abrasion resistant quality. This blended weave can be purchased from commercial resources and is sometimes referred to as "NPMTBA Mill fabric No. 151,012,000". This product can be in the form of Kevlar® fabric material, Cordura, or ballistic cloth. This type of material has highly abrasive-resistant properties which possess superior strength and bursting strength characteristics, as well as superior tensile and tearing strength characteristics.

Figure 3:
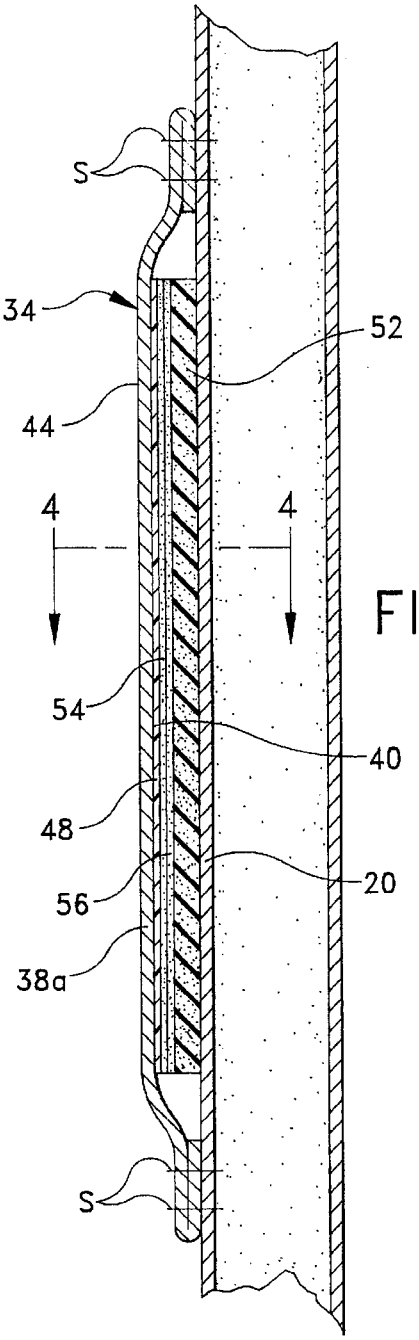
FIG. 3 is a cross-sectional view taken along line 3—3 of FIG. 1.
Figure 5:
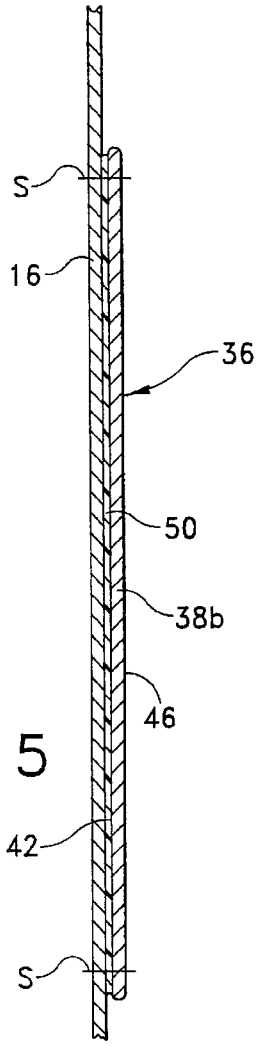
FIG. 5 is a cross-sectional view taken along line 5—5 of FIG. 2.
Figure 4:
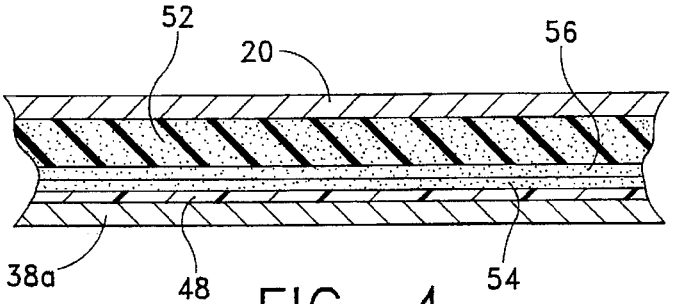
FIG. 4 is a cross-sectional view taken along line 4—4 of FIG. 3.

Turning to the cross-sectional views, namely FIGS. 3–5, the overlay panels 34, 36 include, respectively, a panel 38*a*, 38*b* of sheet material having an inner surface 40, 42, an outer surface 44, 46, and a polyurethane coating 48, 50 which is adhered to the inner surface 40, 42 of the panel 38*a*, 38*b* for preventing migration of moisture through the panel 38*a*, 38*b*.More specifically, the coatings 48, 50 prevent the absorption of water, liquid chemicals and the like and avoids penetration of such chemicals into the fabric comprising the pant legs 20 and rear panel 16. The provision of such abrasive-resistant material at the wear points, i.e., the knee and seat areas, enables the garment 10 to withstand excessive abrasion and wear and tear. As will become readily apparent below, although the above-identified U.S. Pat. No. 5,038,408 discloses reinforcement panels fabricated from leather located at the knees and seat of the pants, the overlay panels 34, 36 of the present invention are far superior with regards to abrasion resistance, industrial washing capabilities, water resistance and cost.

Referring now to FIGS. 3 and 4, each knee portion overlay panel 34 includes the aforementioned panel 38*a* of abrasive-resistant material which is backed by a layer of clear polyurethane coating 48 which is applied on inner surface 40, along with a closed cellular foam pad 52 which is adhered to the panel 38*a*, and more particularly to the polyurethane coating 48. This foam pad 52 is preferably fabricated from a closed cell foamed polymer (e.g., Neoprene), and provides the wearer of the garment 10 increased protection and comfort to the wearer's knees. The thickness of the foam pad 52 can range between 3/16 to 5/8 of an inch. A two-part contact adhesive material is applied to the foam pad 52 and the polyurethane coating 48 of the overlay panel 34 for adhering the pad 52 to the panel 38*a*. As illustrated in FIG. 4, one layer of contact adhesive material 54 is applied to the urethane coating 48. This layer 54 cooperates with another layer of contact adhesive material 56 which is applied to the foam pad 52 for securely fixing the foam pad 52 to the panel 38*a*. The two-part contact adhesive material embodying layers 54, 56 can be chosen from any number of available adhesives, including one such adhesive sold under the trade name "Bond-Plus". By securing the foam pad 52 to the panel 38*a*, the maintenance of the pad 52 at the knee portion of the garment 10 is ensured. A urethane based adhesive can be used as well. Also, a heat fusion process comprising applying a dry adhesive between the poly-urethane coating 48 and the pad 52 and heating the arrangement to bond the pad to the polyurethane coating can also be followed.

Referring to FIGS. 2 and 5, the seat overlay panels 36 are similarly constructed as the knee overlay panels 34 in that they comprise a panel 38*b* which has a layer of polyurethane 50 applied thereto on surface 42. However, the seat area of the garment 10 does not require a pad or other similar material. As illustrated in FIG. 2, each seat pocket 32 is created by forming the outline of the seat pocket 32 with stitching S which attaches the seat overlay panels 36 to the seat panel 16.

The pant garment 10 of the present invention, after being assembled to assume its configuration illustrated in FIGS. 1 and 2, can be treated with any number of chemicals, dyes and other materials for water proofing it and for obtaining a desirable color. The processing of the pant garment 10 can be conducted in accordance with well-known procedures in the art.

The operation and advantages of the present invention will now be readily understood in light of the above-description. It is clear that the pant garment 10 is particularly useful in construction and landscape work. When roofing, for example, the worker often kneels and sits while laying paper and shingles in place. Commercially available denim jeans quickly wear out under such use, thus causing some discomfort to the worker and eventually the wearing out of the jeans.

When the work pant garment 10 of the present invention is used in roofing and other similar work which causes excessive wear and tear on the garment 10, the advantages over commercially available work jeans, and the pants disclosed in U.S. Pat. No. 5,038,408 are readily appreciable. The construction of the overlay panels 34, 36 with ultra-high abrasive-resistant fabric made from a blend of nylon and polypropylene materials enables them to protect the knee portions and seat of the garment 10 without having to resort to expensive materials, such as leather. The overlay panels 34, 36 of the present invention are thinner than leather and are more wear resistant. Moreover, this blend of materials can be washed without risk of its destruction as witnessed by leather. This is especially true for industrial washers which heat the water to temperatures up to 200° F. The panels 34, 36 are capable of withstanding such treatment.

It is also understood that the work pants of the subject invention is particularly applicable for use by workers in various working areas wherein the wearer frequently kneels or sits when working, such as for example, mechanics or ground crew in the aircraft industry, golf course groundkeepers who apply chemicals to ground areas, maintenance workers in public or private industry, boating crews who are constantly kneeling, workers who apply pest control chemicals, line crews, and in many other industrial areas where the wearer sits or kneels while working.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A work pant garment for use by a wearer in an environment wherein the garment is subject to excessive wear conditions, comprising an upper portion that includes a seat and a lower portion that includes pant legs that are integrally joined to said seat and that extend downwardly therefrom, both said upper and lower portions being formed of a woven material that is comprised of heavy duty yarns, and said seat and pant legs each having an overlay panel affixed thereto, each of said overlay panels being formed of an abrasion-resistant material that is defined by woven yarns that are selected from a group consisting of nylon and polypropylene and that include an inner surface and an outer surface, and a polyurethane coating being adhered to the inner surfaces of said overlay panels for preventing migration of moisture through said panels.

2. A work pant garment as claimed in claim 1, said overlay panels being formed of a blended weave of nylon and polypropylene materials.

3. A work pant garment as claimed in claim 1, each of said pant legs having a knee portion on which the overlay panel is applied, said knee portion overlay panel further including a closed cellular foam pad that is adhered to said abrasion-resistant woven material.

4. A work pant garment as claimed in claim 3, a layer of contact adhesive material being applied to said foam pad for adhering said foam pad to said overlay panel.

5. A work pant garment as claimed in claim 4, a layer of contact adhesive material being applied to said polyurethane coating material and cooperating with the layer of contact adhesive material applied to said foam pad for securely fixing said foam pad to said abrasion-resistant material.

6. A work pant garment as claimed in claim 5, said upper and lower portions other than said overlay panels being comprised of 8½ ounce blended twill fabric material and being formed in a blend of 65 percent polyester and 35 percent cotton.

7. A work pant garment as claimed in claim 6, said overlay panel being formed of a blended weave of nylon and polypropylene materials.

* * * * *